United States Patent [19]

Hasegawa

[11] Patent Number: 4,506,641

[45] Date of Patent: Mar. 26, 1985

[54] IDLING RPM FEEDBACK CONTROL METHOD FOR INTERNAL COMBUSTION ENGINES

[75] Inventor: Shumpei Hasegawa, Niiza, Japan

[73] Assignee: Honda Giken Kogyo Kabushiki Kaisha, Tokyo, Japan

[21] Appl. No.: 581,255

[22] Filed: Feb. 17, 1984

[30] Foreign Application Priority Data

Feb. 25, 1983 [JP] Japan ..... 58-30458

[51] Int. Cl.[3] ..... F02D 31/00

[52] U.S. Cl. ..... 123/339; 123/320; 123/328

[58] Field of Search ..... 123/339, 492, 493, 327, 123/328, 320

[56] References Cited

U.S. PATENT DOCUMENTS

| | | | |
|---|---|---|---|
| 4,291,656 | 9/1981 | Miyagi | 123/339 |
| 4,386,591 | 6/1983 | Nagase | 123/339 |
| 4,406,261 | 9/1983 | Ikeura | 123/339 |

*Primary Examiner*—Ronald B. Cox
*Attorney, Agent, or Firm*—Arthur L. Lessler

[57] ABSTRACT

A method for controlling the quantity of supplementary air being supplied to an internal combustion engine during idling operation thereof in a feedback manner responsive to the difference between the actual engine rpm and desired idling rpm. When the engine is operating in a decelerating condition with the throttle valve fully closed, a provisional value of desired idling rpm is set, which is larger than a proper value of desired idling rpm by a predetermined amount. The quantity of supplementary air is controlled in a feedback manner responsive to the difference between the actual value of engine rpm and the provisional value of desired idling rpm for a predetermined period of time from the time a predetermined condition of feedback control for bringing the engine rpm to the provisional value of desired idling rpm has been satisfied as a result of comparison between the actual value of engine rpm and the provisional value of desired idling rpm. Preferably, the predetermined condition of feedback control is satisfied when the actual engine rpm has decreased below the provisional value of desired idling rpm for the first time. After the lapse of the predetermined period of time, control of the supplementary air quantity is effected in a feedback manner responsive to the difference between the actual value of engine rpm and the proper value of desired idling rpm.

6 Claims, 4 Drawing Figures

9
CPU
903
907
ROM
908
RAM
909
DRIVING CIRCUIT
911
DRIVING CIRCUIT
10
FUEL INJECTION VALVES
6
CONTROL VALUE
902
Me COUNTER
910
906
A/D CONVERTER
905
MULTI-PLEXER
913
DATA INPUT CIRCUIT
901
WAVEFORM SHAPER
904
LEVEL SHIFTER UNIT
912
LEVEL SHIFTER
RPM SENSOR
14
THROTTLE SENSOR
17
TEMP. SENSOR
13
PRESS. SENSOR
12
SWITCH
16

IDLING RPM FEEDBACK CONTROL METHOD FOR INTERNAL COMBUSTION ENGINES

BACKGROUND OF THE INVENTION

This invention relates to an idling rpm feedback control method for internal combustion engines, and more particularly to a method of this kind which can prevent engine stall during transition of the engine operation from a decelerating condition with the throttle valve fully closed to the idling rpm feedback controlling condition.

In an internal combustion engine, the engine can easily stall due to a drop in the engine speed when the engine is operated in an idling condition at a low temperature of the engine cooling water or when the engine is heavily loaded with electrical loads by head lamps, fans, etc. in a vehicle equipped with the engine. To eliminate such disadvantage, an idling rpm feedback control method has been proposed e.g. by Japanese Provisional Patent Publication (Kokai) No. 55-98628, which comprises setting desired idling rpm in dependence upon load on the engine, detecting the difference between the actual engine rpm and the desired idling rpm, and supplying supplementary air to the engine in a quantity corresponding to the detected difference so as to minimize the same difference, to thereby control the engine rpm to the desired idling rpm.

According to this proposed method, if the idling rpm feedback control is carried out immediately when the engine is decelerated toward the desired idling rpm region with the throttle valve fully closed and before the engine speed drops to the desired idling rpm region, the resulting controlled quantity of supplementary air is much smaller than a required quantity to be supplied to the engine, because on such occasion the supplementary air quantity is controlled to such a small value as to immediately bring the engine rpm to the desired idling rpm. If on such occasion the clutch of the engine is disengaged, there occurs a sudden drop in the engine speed, which can cause engine stall.

To avoid this disadvantage, an idling rpm feedback control method has been proposed e.g. by Japanese Provisional Patent Publication (Kokai) No. 55-98629. According to this proposed method, in transition from a decelerating condition to an idling rpm feedback controlling condition, the quantity of supplementary air is controlled in decelerating mode wherein the quantity of supplementary air required for maintaining the engine rpm at the desired idling rpm is estimated in advance of the completion of the transition of the engine operation and the estimated quantity of supplementary air is previously supplied to the engine before the idling rpm feedback control is started, to thereby ensure smooth transition to the idling operation.

However, even if the above decelerating mode control of the supplementary air quantity is carried out in advance of the completion of the transition of the engine operation to the idling rpm feedback controlling condition, the engine speed can temporarily drop below the desired idling rpm before it is controlled to or in the vicinity of the desired idling rpm, if the rate of decrease in the engine rpm is large, for instance, when the clutch is disengaged while the engine is decelerating with large loads applied on it, such as electrical loads. If the rate of decrease in the engine rpm is too large, it will easily cause engine stall and give discomfort to the driver, as stated before.

SUMMARY OF THE INVENTION

It is the object of the invention to provide an idling rpm feedback control method which is capable of obtaining smooth transition of the engine operation from a decelerating condition to an idling rpm feedback controlling condition, to thereby prevent engine stall, etc.

According to the invention, a method is provided for controlling the quantity of supplementary air being supplied to an internal combustion engine during idling operation thereof in a feedback manner responsive to the difference between the actual engine rpm and desired idling rpm. The method according to the invention is characterized by comprising the steps of: (a) setting a provisional value of desired idling rpm which is larger than a proper set value of the desired idling rpm by a predetermined amount, when the engine is operating in a decelerating condition with the throttle valve fully closed; (b) controlling the quantity of supplementary air in a feedback manner responsive to the difference between the actual value of engine rpm and the provisional value of desired idling rpm for a predetermined period of time from the time a predetermined condition of feedback control for bringing the engine rpm to the provisional value of desired idling rpm has been satisfied as a result of comparison between the actual value of engine rpm and the provisional value of desired idling rpm; and (c) controlling the quantity of supplementary air in a feedback manner responsive to the difference between the actual value of engine rpm and the proper value of desired idling rpm, after the lapse of the predetermined period of time.

Preferably, the aforementioned predetermined amount in the step (a) is set at a fixed value independent of the proper set value of the desired idling rpm. Also preferably, the predetermined condition of feedback control in the step (b) is determined to be satisfied when the actual value of engine rpm has decreased below the provisional value of desired idling rpm for the first time. Further, once the above feedback control of the quantity of supplementary air for controlling the actual engine rpm to the proper set value of desired idling rpm has been initiated, the same feedback control is continuously effected, even if the actual engine rpm exceeds the provisional value of desired idling rpm, so long as neither of the conditions is satisfied that the actual engine rpm exceeds a predetermined value of engine rpm which is larger than the provisional value of desired idling rpm and that the throttle valve is opened.

Further, preferably the engine includes an air passage having one end communicating with the intake passage at a location downstream of a throttle valve therein and another end with the atmosphere, respectively, and a supplementary air quantity control valve arranged across the air passage. The supplementary air quantity is controlled by regulating the supplementary air quantity control valve.

The above and other objects, features and advantages of the invention will be more apparent from the ensuing detailed description taken in conjunction with the accompanying drawings.

DETAILED DESCRIPTION

The method of the invention will be described in detail with reference to the accompanying drawings.

Figure 1:
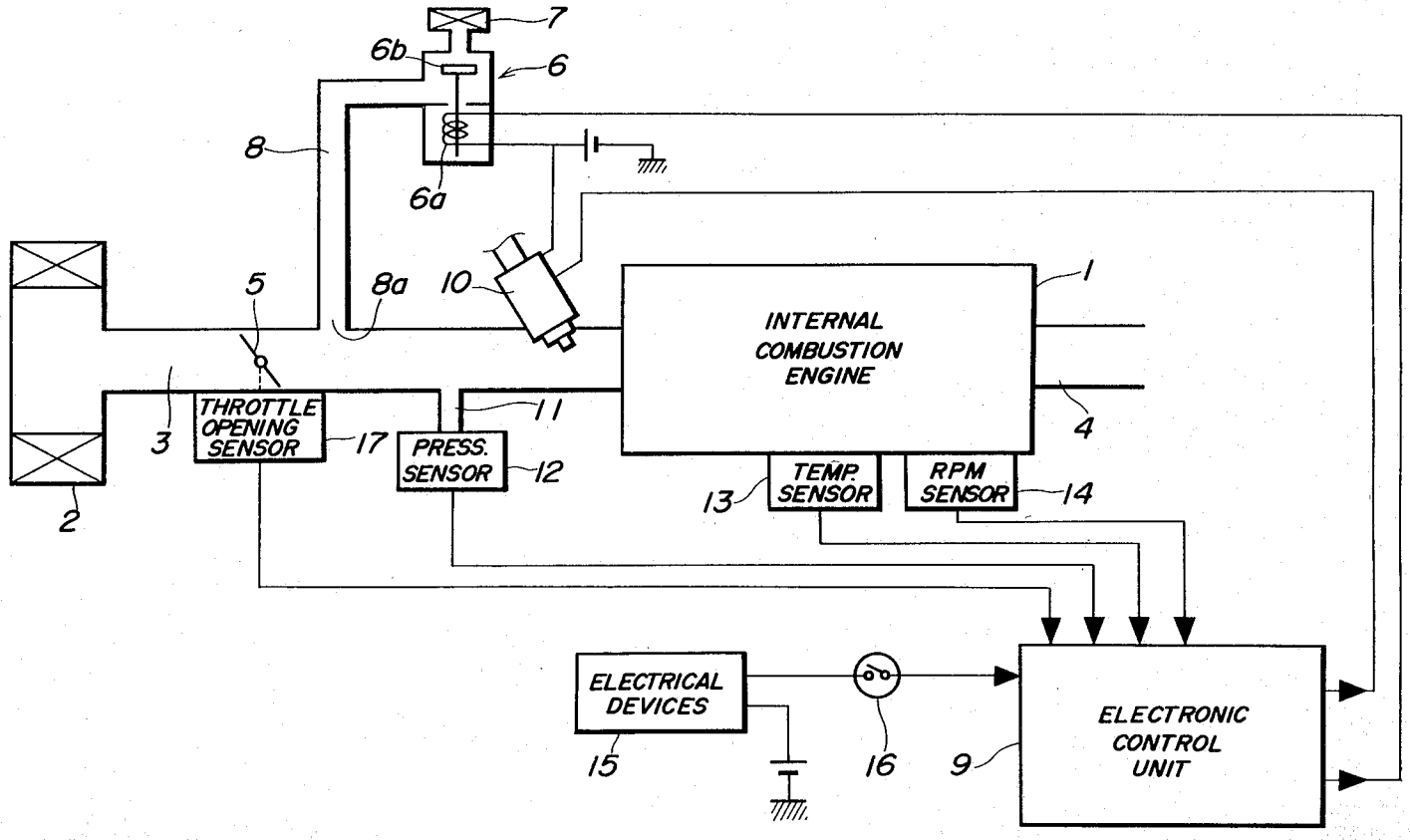
FIG. 1 is a block diagram illustrating the whole arrangement of an idling rpm feedback control system to which is applicable the method of the invention.

Referring first to FIG. 1, an idling rpm feedback control system is schematically illustrated, to which is applicable the method of the invention. In FIG. 1, reference numeral 1 designates an internal combustion engine which may be a four-cylinder type for instance, and to which are connected an intake pipe 3 with an air cleaner 2 mounted at its open end and an exhaust pipe 4, at an intake side and an exhaust side of the engine 1, respectively. A throttle valve 5 is arranged within the intake pipe 3, and an air passage 8 opens at its one end 8*a* in the intake pipe 3 at a location downstream of the throttle valve 5. The air passage 8 has its other end communicating with the atmosphere and provided with an air cleaner 7. A supplementary air quantity control valve (hereinafter called merely "the control valve") 6 is arranged across the air passage 8 to control the quantity of supplementary air being supplied to the engine 1 through the air passage 8. This control valve 6 is a normally closed type and comprises a solenoid 6*a* and a valve 6*b* disposed to open the air passage 8 when the solenoid 6*a* is energized. The solenoid 6*a* is electrically connected to an electronic control unit (hereinafter called "the ECU") 9. A fuel injection valve 10 is arranged in a manner projected into the intake pipe 3 at a location between the engine 1 and the open end 8*a* of the air passage 8, and is connected to a fuel pump, not shown, and also electrically connected to the ECU 9.

A throttle valve opening sensor 17 is mounted on the throttle valve 5, and an absolute pressure sensor 12 is provided in communication with the intake pipe 3 through a conduit 11 at a location downstream of the open end 8*a* of the air passage 8, while an engine cooling water temperature sensor 13 and an engine rotational angle position (rpm) sensor 14 are both mounted on the body of the engine 1. All the sensors are electrically connected to the ECU 9. Reference numeral 15 designates electrical devices such as head lamps and fans, which are electrically connected to the ECU 9 by way of respective switches 16.

The idling rpm feedback control system constructed as above operates as follows: Various engine operation parameter signals are supplied to the ECU 9 from the throttle valve opening sensor 17, the absolute pressure sensor 12, the engine cooling water temperature sensor 13, and the engine rotational angle position (rpm) sensor 14. Then, the ECU 9 determines operating conditions of the engine 1 and loaded conditions of same on the basis of the read values of these engine operation parameter signals and a signal indicative of electrical loads on the engine supplied to the ECU 9 from the electrical devices 15, and then calculates a desired quantity of fuel to be supplied to the engine 1, that is, a desired valve opening period of the fuel injection valve 10, and also a desired quantity of supplementary air to be supplied to the engine 1, that is, a desired valve opening period of the control valve 6, on the basis of the determined operating conditions and loaded conditions of the engine. Then, the ECU 9 supplies driving pulses as control signals corresponding to the calculated values to the fuel injection valve 10 and the control valve 6, for driving the same valves.

The control valve 6 has its solenoid 6*a* energized by each of its driving pulses to open its valve body 6*b*, thereby opening the air passage 8 for a period of time corresponding to its calculated valve opening period value so that a quantity of supplementary air corresponding to the calculated valve opening period value is supplied to the engine 1 through the air passage 8 and the intake pipe 3.

The fuel injection valve 10 is energized by each of its driving pulses to open for a period of time corresponding to its calculated valve opening period value to inject fuel into the intake pipe 3. The ECU 9 operates so as to supply an air/fuel mixture having a desired air/fuel ratio, e.g. a stoichiometric air/fuel ratio, to the engine 1.

When the valve opening period of the control valve 6 is increased to increase the quantity of supplementary air, an increased quantity of the mixture is supplied to the engine 1 to increase the engine output, resulting in an increase in the engine rpm, whereas a decrease in the above valve opening period causes a corresponding decrease in the quantity of the mixture, resulting in a decrease in the engine rpm. In this manner, the engine speed is controlled by controlling the quantity of supplementary air or the valve opening period of the control valve 6.

Figure 2:
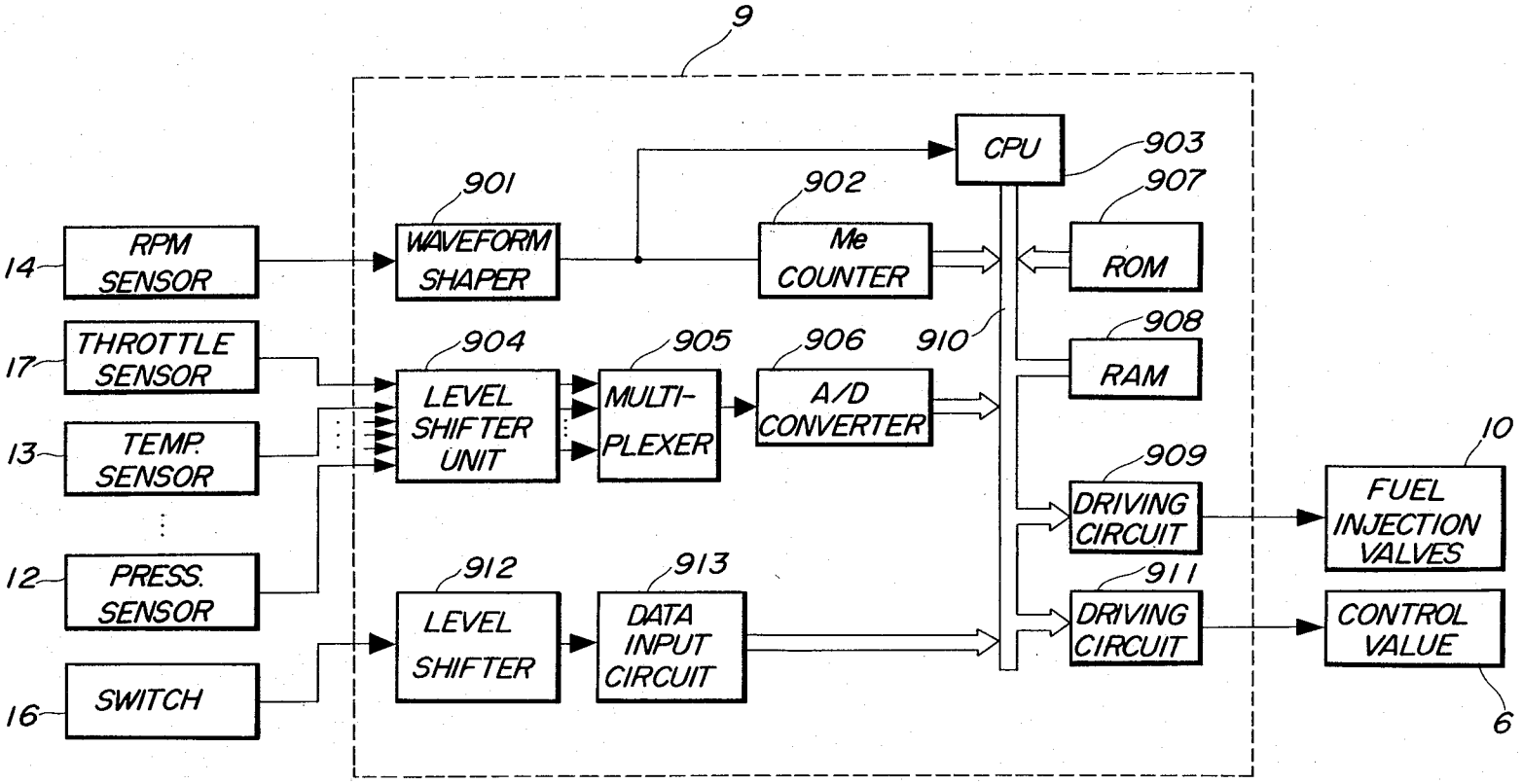
FIG. 2 is a circuit diagram showing an example of the internal arrangement of an electronic control unit (ECU) in FIG. 1.

FIG. 2 shows a circuit configuration within the ECU 9 in FIG. 1. An output signal from the engine rotational angle position (rpm) sensor 14 is applied to a waveform shaper 901, wherein it has its pulse waveform shaped, and supplied to a central processing unit (hereinafter called "the CPU") 903, as a TDC signal indicative of top dead centers of engine pistons, as well as to an Me value counter 902. The Me value counter 902 counts the interval of time between a preceding pulse of the TDC signal generated at a predetermined crank angle of the engine and a present pulse of the same signal generated at the same crank angle, inputted thereto from the engine rotational angle position sensor 14, and therefore its counted value Me corresponds to the reciprocal of the actual engine rpm Ne. The Me value counter 902 supplies the counted value Me to the CPU 903 via a data bus 910.

The respective output signals from various sensors such as the throttle valve opening sensor 17, the intake pipe absolute pressure sensor 12 and the engine cooling water temperature sensor 13 in FIG. 1 have their voltage levels shifted to a predetermined voltage level by a level shifter unit 904 and successively applied to an analog-to-digital converter 906 through a multiplexer 905. The analog-to-digital converter 906 successively converts into digital signals analog output voltages from the aforementioned various sensors, and the resulting digital signals are supplied to the CPU 903 via the data bus 910.

An output signal indicative of on- and off-states of the electrical devices 15 in FIG. 1, supplied from the switches 16, has its voltage level shifted to a predetermined level by a level shifter 912, and then applied to the CPU 903 via the data bus 910 after it is converted into a predetermined signal by a data input circuit 913.

Further connected to the CPU 903 via the data bus 910 are a read-only memory (hereinafter called "the ROM") 907, a random access memory (hereinafter called "the RAM") 908 and driving circuits 909 and 911. The RAM 908 temporarily stores various calculated values from the CPU 903, while the ROM 907 stores a control program executed within the CPU 903, etc.

The CPU 903 executes the control program stored in the ROM 907 to determine operating conditions and loaded conditions of the engine, etc. on the basis of the aforementioned various engine operation parameter signals. Further, the CPU 903 calculates the duty ratio DOUT of driving pulses which determines the valve opening period of the control valve 6 to determine the quantity of supplementary air as well as the duty ratio of driving pulses which determines the valve opening period of the fuel injection valve 10, and supplies control signals corresponding to the calculated duty ratio values, to the respective driving circuits 911 and 909, via the data bus 910. The driving circuit 909 supplies a driving signal corresponding to its input control signal to the fuel injection valve 10 to open same, while the driving circuit 911 supplies a driving signal corresponding to its input control signal to the control valve 6 to open same.

The manner of controlling the idling rpm in feedback mode according to the method of the invention will now be described with reference to the flow chart of FIG. 3 as well as to the graph of FIG. 4. The control program of FIG. 3 is executed within the CPU 903 in synchronism with generation of pulses of the TDC signal generated by the (rpm) sensor 14.

Figure 3:
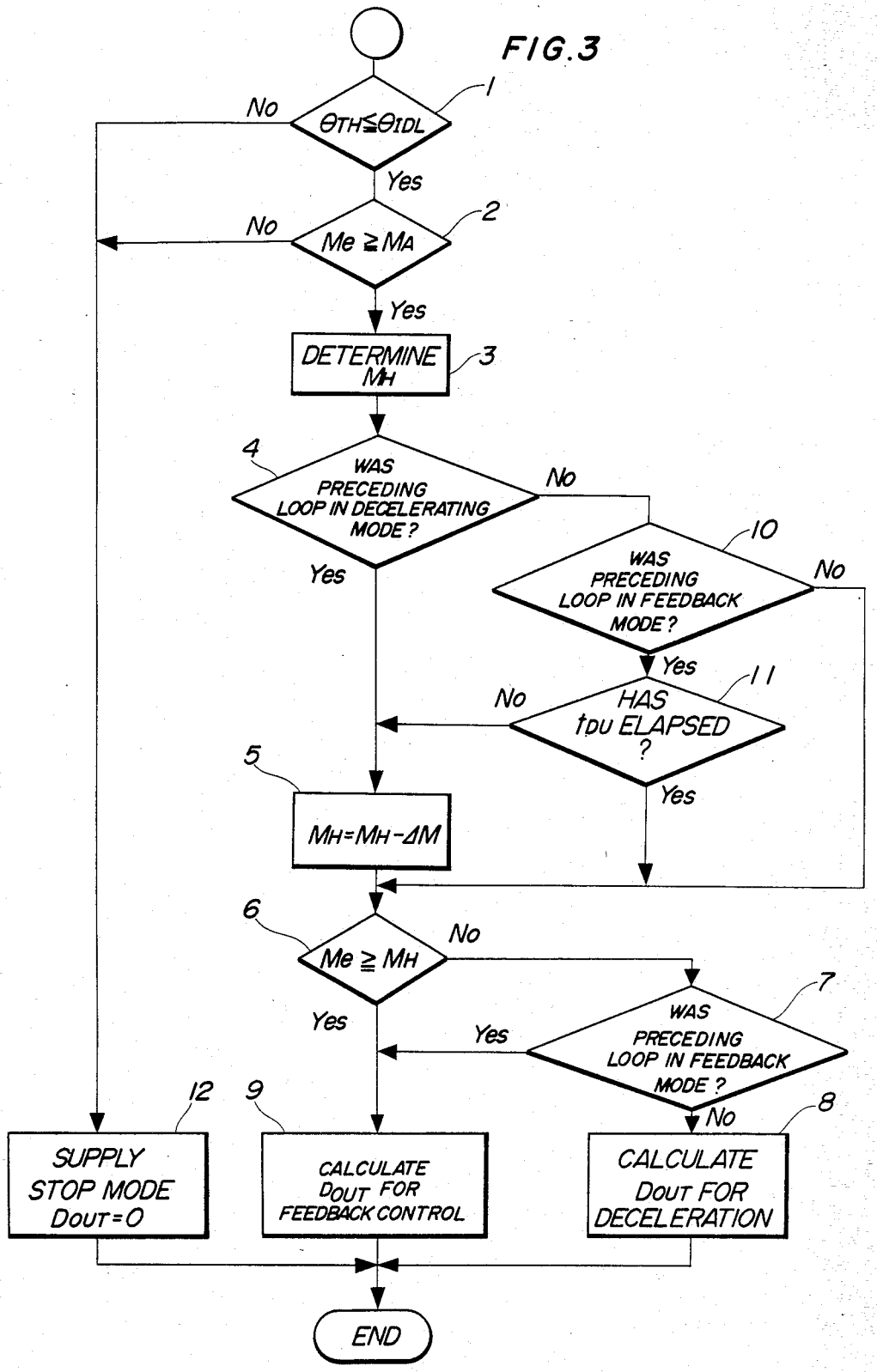
FIG. 3 is a flow chart showing a routine for executing the method of the invention, which can be executed within the electronic control unit (ECU) in FIG. 1.

Referring to FIG. 3, first, a determination is made as to whether or not the engine is in an operating condition requiring the supply of supplementary air to the engine, at the steps 1 and 2. That is, at the step 1, it is determined as to whether or not a detected value of the throttle valve opening is smaller than a value $\theta$IDL corresponding to a substantially fully closed position of the throttle valve. Then, a determination is made at the step 2 as to whether or not the aforementioned counted value Me, which is proportional to the reciprocal of the engine rpm Ne, is larger than a value MA which is proportional to the reciprocal of a predetermined rpm value NA (e.g. 1500 rpm). If either of the answers to the determinations at the steps 1 and 2 is negative or no, that is, when the throttle valve is in an open position or the engine rpm Ne is larger than the predetermined rpm value NA, as indicated by the symbol Sm in FIG. 4, the ECU 9 halts the supply of a driving signal to the control valve 6 to cause same to be fully closed, by setting the duty ratio DOUT to zero, at the step 12, as the supply of supplementary air to the engine is then unnecessary because there is no fear of engine stall or vibrations of the engine which can occur when the engine rotational speed is low. This setting of the duty ratio DOUT will hereinafter be referred to as "supply stop mode". In this manner, when the supply of supplementary air is not required, no energization of the control valve 6 is effected so as to prohibit repeated opening and closing actions of the valve body 6*b* and minimize the adverse influence of heat from the energized solenoid 6*a* upon the valve body 6*b*, thereby prolonging the life of the valve body 6*b*.

Figure 4:
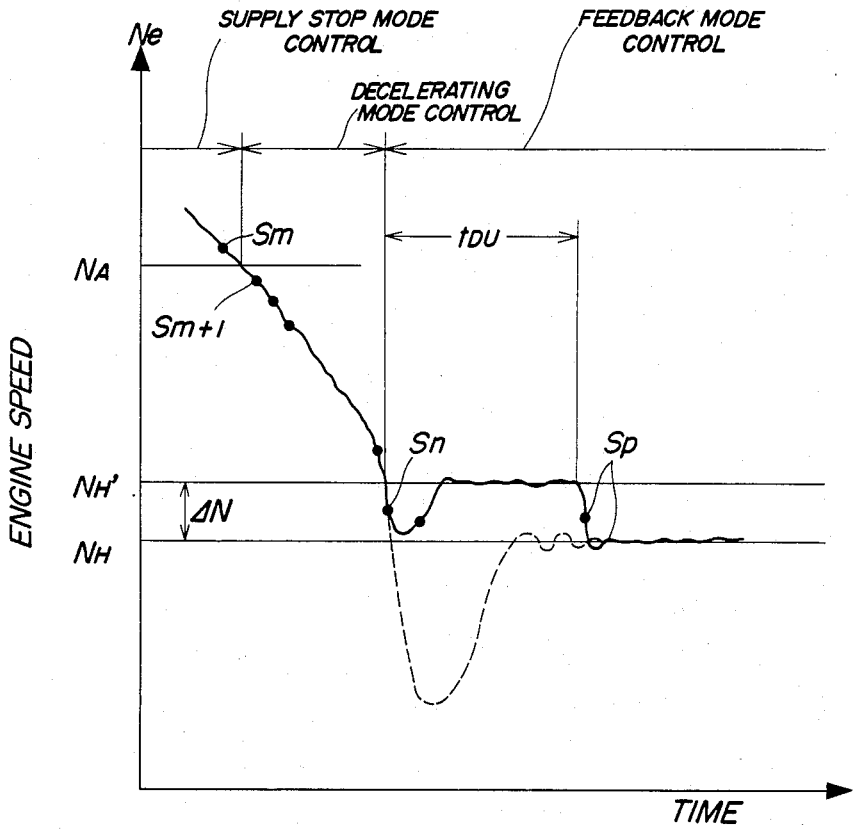
FIG. 4 is a timing chart showing a manner of change in the engine rpm with respect to the lapse of time, which can be obtained by the method of the invention.

When the engine rpm Ne decreases so that the answer to the question of the step 2 becomes affirmative or yes, with the throttle valve substantially fully closed, that is, the engine rpm Ne becomes lower than the predetermined rpm value NA, as indicated by the symbol Sm+1 in FIG. 4, the program proceeds to the step 3 to set a value MH which is proportional to the reciprocal of a desired idling rpm value NH. The value MH is set to a value corresponding to loads on the engine at idle, including cooling water temperature represented by an output signal from the engine cooling water temperature sensor 13.

Next, at the steps 4 and 10, it is determined whether the preceding loop of control of the supplementary air quantity was executed in decelerating mode or in feedback mode. If the answers to the questions at the steps 4, 10 are both negative (no), that is, when the preceding loop was not executed in either decelerating mode or feedback mode, in other words, if the preceding loop was executed in supply stop mode or the throttle valve 5 was in an open state in the preceding loop, the program proceeds to the step 6 to determine whether or not the value Me proportional to the reciprocal of the engine rpm Ne is larger than the value MH determined at the step 3. If the answer to the question at the step 6 is no, that is, if the engine rpm Ne is larger than the desired idling rpm value NH, the program proceeds to the step 7 to again determine whether or not the preceding loop was executed in feedback mode. On this occasion, at the step 7, the same answer as in the above step 10 is naturally obtained that the preceding loop was not executed in feedback mode. Then, the program proceeds to the step 8 to calculate the duty ratio DOUT for decelerating mode control.

The duty ratio DOUT for decelerating mode control is set, for instance, to a value which is the sum of a deceleration mode term DX and an electrical load term DE. The deceleration mode term DX may be set at a constant value corresponding to an expected amount of supplementary air required for maintaining the engine rpm Ne at the desired idling rpm applied when the engine is operating in an idling condition at a temperature of engine cooling water above a predetermined value (e.g. 70° C.) and with no electrical load applied on the engine by the electrical devices 15. Alternatively, the same term DX may be set such that it gradually increases with a decrease in the engine rpm Ne until it reaches the above constant value from the time the engine rpm Ne drops below the aforesaid predetermined rpm value NA to the time the engine rpm Ne reaches a provisional value NH' of desired idling rpm hereinafter referred to. The electrical load term DE is set to a value selected from a plurality of predetermined values which are previously set, in response to on-off states of the electrical devices 15.

When the preceding loop of control of the supplementary air quantity was executed in decelerating mode, the answer to the determination at the step 4 becomes yes, and the program skips the step 10 and proceeds to the step 5, to set the provisional desired idling rpm value NH'. This provisional value NH' is set at a value larger than the desired idling rpm NH by a predetermined amount $\Delta$N. The provisional desired idling rpm value NH' is provided for quickening the transition from the decelerating mode control to the feedback mode control, to thereby prevent a sudden drop in the engine rpm, etc. as hereinafter described in detail. The setting of the provisional desired idling rpm value NH' at the step 5 is carried out by subtracting a value $\Delta$M corresponding to the predetermined amount $\Delta$N from the value MH obtained at the step 3 and substituting the resultant difference value (MH-$\Delta$M) as a new MH value. The value $\Delta$M, i.e. the predetermined amount ΔN, may either be a variable as a function of the value MH corresponding to the desired idling rpm value NH obtained at the step 3, or a constant value independent of the value MH.

Once the value MH proportional to the reciprocal of the provisional desired idling rpm value MH' has been set in the above manner at the step 5, the step 8 is repeatedly executed to continuously control the quantity of supplementary air in decelerating mode until the engine rpm Ne reaches the provisional desired idling rpm value NH', that is, until the answer to the determination at the step 6 becomes affirmative.

When the determination at the step 6 becomes yes or the relationship Me≧MH stands, that is, when the engine rpm Ne is decreased below the provisional desired idling rpm value NH', as indicated by the symbol Sn in FIG. 4, it is determined that a predetermined condition of feedback control for bringing the engine rpm Ne to the provisional desired idling rpm value NH' has been satisfied, and the program proceeds to the step 9 to calculate the duty ratio DOUT for the valve opening period of the control valve 6 in feedback mode. The duty ratio DOUT applicable to the feedback mode control is obtained, for instance, as a sum of a feedback mode term DPIn and the afore-mentioned electrical load term DE. The feedback mode term DPIn is set in response to the difference between the actual engine rpm Ne and the provisional desired idling rpm value NH' so as to make the same difference zero, that is, to make the engine rpm Ne equal to the provisional desired idling rpm value NH'. Since the provisional desired idling rpm NH' is thus applied to control of the engine rpm in transition of the engine operation from a decelerating condition to the idling rpm feedback controlling condition so as to advance the start of the feedback mode control, a sudden drop in the engine rpm, as shown by the broken line in FIG. 4, can be prevented, that can occur upon disengagement of the clutch of the engine while the engine is decelerating with large loads applied thereon.

After the feedback mode control has been initiated to bring the engine rpm Ne to the provisional desired idling rpm value NH', a negative answer is obtained at the step 4 that the preceding loop was not executed in decelerating mode, and an affirmative answer at the step 10, respectively, in the following loops. Accordingly, the program proceeds to the step 11 to determine whether or not a predetermined period of time tDU (e.g. 2 seconds) has elapsed since the initiation of the feedback mode control. As long as the answer to the determination at the step 11 remains negative, the steps 5, 6 and 9 are sequentially executed to continuously effect the feedback mode control to bring the engine rpm NE to the provisional desired idling rpm value NH'. On the other hand, when the determination at the step 11 gives an affirmative answer, that is, after the above predetermined period of time tDU has elapsed, the program skips over the step 5 but directly to the step 6 to determine whether or not the aforesaid value Me is larger than the value MH which is obtained at the step 3. On this occasion, irrespective of the answer to the determination at the step 6, the program proceeds to the step 9 without fail, because if the engine rpm Ne is determined, at the step 6, to be larger than the desired idling rpm value NH obtained at the step 3, an affirmative answer is obtained at the following step 7 that the preceding loop was executed in feedback mode, followed by the program proceeding to the step 9, whereas when the determination at the step 6 is yes, the program directly proceeds to the step 9. Therefore, after the lapse of the predetermined period of time tDU, the feedback mode control is carried out to control the engine rpm Ne to the desired idling rpm value NH in place of the provisional desired idling rpm value NH', as shown by the symbol Sp in FIG. 4, and thereafter the same feedback mode control is continuously carried out so long as the throttle valve 5 remains closed.

What is claimed is:

1. A method for controlling the quantity of supplementary air being supplied to an internal combustion engine during idling operation thereof in a feedback manner responsive to the difference between actual engine rpm and desired idling rpm, said engine having an intake passage, and a throttle valve arranged in said intake passage, said method comprising the steps of:

(a) setting a provisional value of desired idling rpm which is larger than a proper value of said desired idling rpm by a predetermined amount, when said engine is operating in a decelerating condition with said throttle valve fully closed;

(b) determining whether or not a predetermined condition of feedback control for bringing the engine rpm to said provisional value of desired idling rpm is satisfied, said predetermined condition being satisfied when the actual engine rpm has decreased below said provisional value of desired idling rpm;

(c) controlling the quantity of supplementary air in a feedback manner responsive to the difference between said actual value of engine rpm and said provisional value of desired idling rpm for a predetermined period of time from the time it is determined in said step (b) that said predetermined condition of feedback control for bringing the engine rpm to said provisional value of desired idling rpm has been satisfied; and (d) controlling the quantity of supplementary air in a feedback manner responsive to the difference between said actual value of engine rpm and said proper value of desired idling rpm, after the lapse of said predetermined period of time.

2. A method as claimed in claim 1, wherein said predetermined amount is set at a fixed value independent of said proper value of said desired idling rpm.

3. A method as claimed in claim 1, including the steps of determining whether or not conditions are satisfied that said actual value of engine rpm exceeds a predetermined value of engine rpm which is larger than said provisional value of engine rpm and said throttle valve is in an open state, after said feedback control in said step (c) has been initiated, and continuing said feedback control in said step (c) so long as neither of said conditions is satisfied.

4. A method as claimed in claim 1, wherein said engine further includes an air passage having one end communicating with said intake passage at a location downstream of said throttle valve and another end with the atmosphere, respectively, and a supplementary air quantity control valve arranged across said air passage, the quantity of supplementary air being controlled by regulating said supplementary air quantity control valve.

5. A method as claimed in claim 2, wherein said proper value of desired idling rpm is set to a value corresponding to loads on the engine.

6. A method as claimed in claim 1, wherein said predetermined period of time is set at a fixed value.

* * * * *